US006325303B1

(12) United States Patent
Kuo

(10) Patent No.: US 6,325,303 B1
(45) Date of Patent: Dec. 4, 2001

(54) STRUCTURE OF SWIVEL LAWN SPRINKLER

(75) Inventor: Mu Shui Kuo, Taipei (TW)

(73) Assignee: Sanmaonet Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/822,240

(22) Filed: Apr. 2, 2001

(51) Int. Cl.[7] ..... B05B 3/00; B05B 3/06

(52) U.S. Cl. ..... 239/225.1; 239/17; 239/211; 239/236; 239/251; 239/255; 239/261; 239/273; 239/263; 239/264; 239/279; 239/280; 40/419; D23/215; D23/222

(58) Field of Search ..... 239/16, 17, 211, 239/225.1, 236, 242, 248, 251, 253, 255, 261, 263, 264, 273, 279, 280, 289; 446/267, 275; 40/412, 417, 419; D23/215, 222

(56) References Cited

U.S. PATENT DOCUMENTS 636,803 * 11/1899 Hollingsworth ..... 239/17
935,071 * 9/1909 Vossler ..... 239/261
1,577,225 * 3/1926 Granger ..... 239/261
1,938,838 * 12/1933 Jacobson ..... 239/236
2,558,663 * 6/1951 Olschewski ..... 239/261

* cited by examiner

*Primary Examiner*—Robin O. Evans
(74) *Attorney, Agent, or Firm*—Rosenberg, Klein & Lee

(57) ABSTRACT

A swivel lawn sprinkler includes a mounting rack for mounting, a water tube vertically connected to the mounting rack by a hose connector and adapted to receive water from a water source through the hose connector, a pipe connector fastened to the top end of the water tube, the pipe connector, a swivel sprinkler head coupled to the pipe connector and forced to rotate on the pipe connector by water pressure when sprinkling, and a slide coupled to swivel sprinkler head and forced to move two ornaments alternatively up and down and to oscillate symmetrical pairs of wings up and down upon rotary motion of the spray tube.

1 Claim, 3 Drawing Sheets

STRUCTURE OF SWIVEL LAWN SPRINKLER

BACKGROUND OF THE INVENTION

The present invention relates to lawn sprinklers and, more particularly, to an improved structure of swivel lawn sprinkler, which oscillates the wings of two figured ornaments when the spray tube is rotated to sprinkle water on the lawn.

In parks, gardens, square plazas, or the like, lawn sprinklers may be provided to sprinkle water on flowers, lawns, trees, and etc. Regular lawn sprinklers are commonly comprised of a fixed spray tube having a plurality of jet nozzles for output of water. These conventional lawn sprinklers do not attract people's attention when sprinkling water on plants because they are immovable.

SUMMARY OF THE INVENTION

It is one object of the present invention to provide a lawn sprinkler, which has a figured swivel sprinkler head that attracts people's attention when sprinkling water on the lawn. It is another object of the present invention to provide a lawn sprinkler, which is forced to rotate the sprinkler head thereof when sprinkling water on the lawns. It is still another object of the present invention to provide a swivel lawn sprinkler, which moves two ornaments alternatively vertically up and down and oscillates symmetrical pairs of wings alternatively up and down upon rotary motion of the spray tube of the swivel sprinkler head during sprinkling.

DETAILED DESCRIPTION OF THE PREFERRED EMBODIMENT

Figure 1:
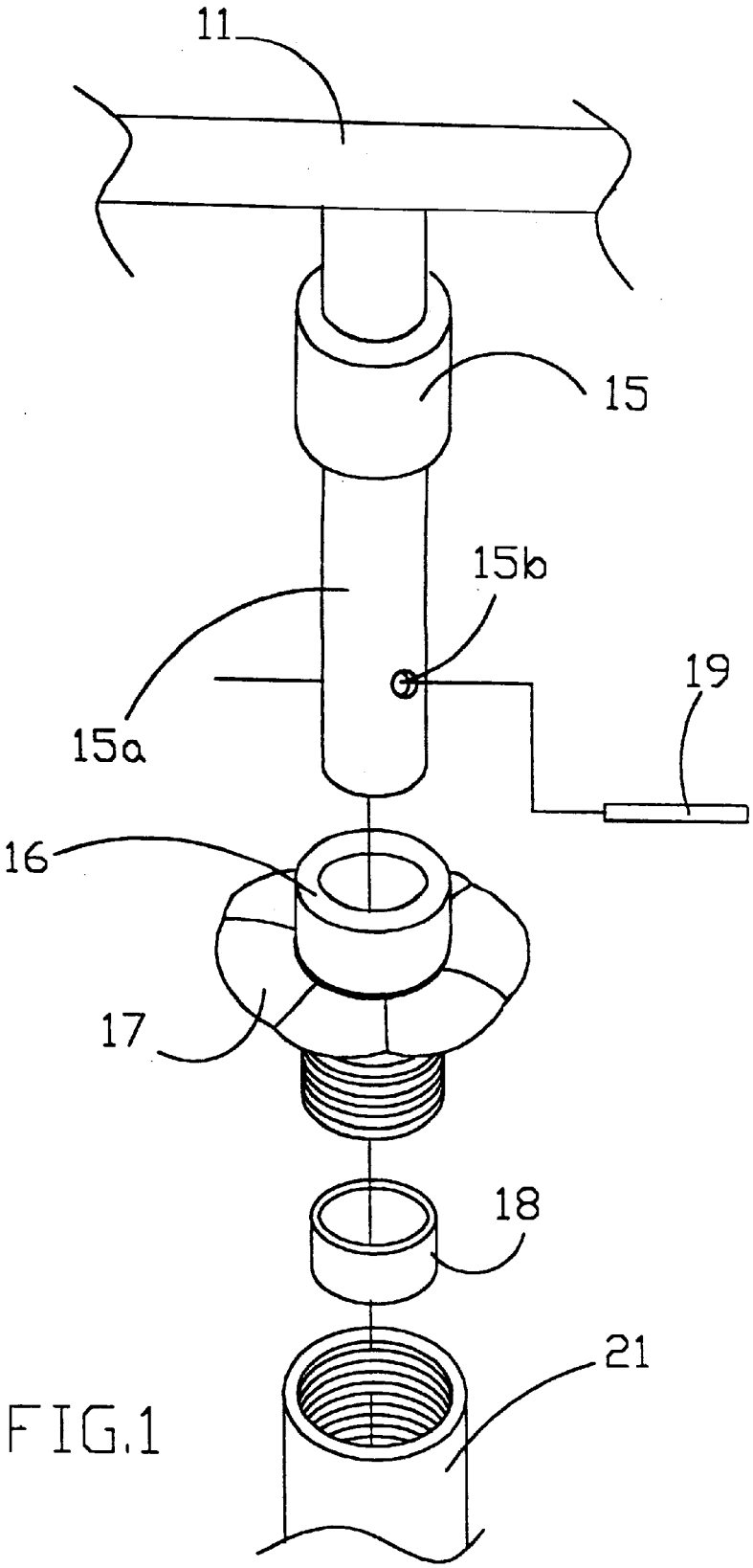
FIG. 1 is an exploded view of a part of the swivel lawn sprinkler constructed according to the present invention.

Referring to FIGS. from 1 through 3, a swivel lawn sprinkler in accordance with the present invention is generally comprised of a swivel sprinkler head 10, a slide 14, a pipe connector 16, a water tube 21, and a mounting rack 22. The sprinkler head 10 comprises a spray tube 11, the spray tube 11 having a plurality of jet nozzles 11*a*, two open frames 12 respectively welded to two distal ends of the spray tube 11, pairs of swivel rods 12*b* symmetrically coupled to the open frames 12 at two sides, the swivel rods 12*b* each having an actuating bottom end 12*c*, a plurality of wings 131 respectively fixedly fastened to the swivel rods 12*b*, and a connecting tube 15 downwardly extended from the spray tube 11 and adapted to guide water into the spray tube 11. The connecting tube 15 has a transverse pinhole 15*b* extended through the lower section 15*a* thereof. The pipe connector 16 is sleeved onto the lower section 15*a* of the connecting tube 15, having a collar 17 disposed around the periphery on the middle. The collar 17 has a top surface alternatively curved inwards and outwards. After insertion of the lower section 15*a* of the connecting tube 15 through the pipe connector 16, a locating ring 18 is sleeved onto the lower section 15*a* of the connecting tube 15 and stopped against the bottom edge of the pipe connector 16, and then a locating pin 19 is fastened to the pin hole 15*b* of the connecting tube 15 to secure the locating ring 18 and the pipe connector 16 to the connecting tube 15, and then the threaded bottom end of the pipe connector 16 is threaded into the inner threads in the top end of the water tube 21 to secure the connecting tube 15 and the spray tube 11 to the water tube 21. The hose connector 21*a* is a three-way pipe fitting, having a first end connected to the bottom end of the water tube 21, a second end connected to the mounting rack 22 and sealed, and a third end connected to the water source by a hose (not shown). The slide 14 is sleeved onto the connecting tube 15 and moved along the connecting tube 15 between the pipe connector 16 and the spray tube 11, comprising two arms 14*a* respectively outwardly extended from two sides thereof, a ball 20 coupled to one arm 14*a* and rotatably disposed in contact with the curved top surface of the collar 17, and two ornaments 13 respectively fixedly fastened to the angled outer end of each of the arms 14*a* and suspending in the open frames 12 at the two distal ends of the spray tube 11. The ornaments 13 each have a plurality of stop rods 13*a*.

Figure 2:
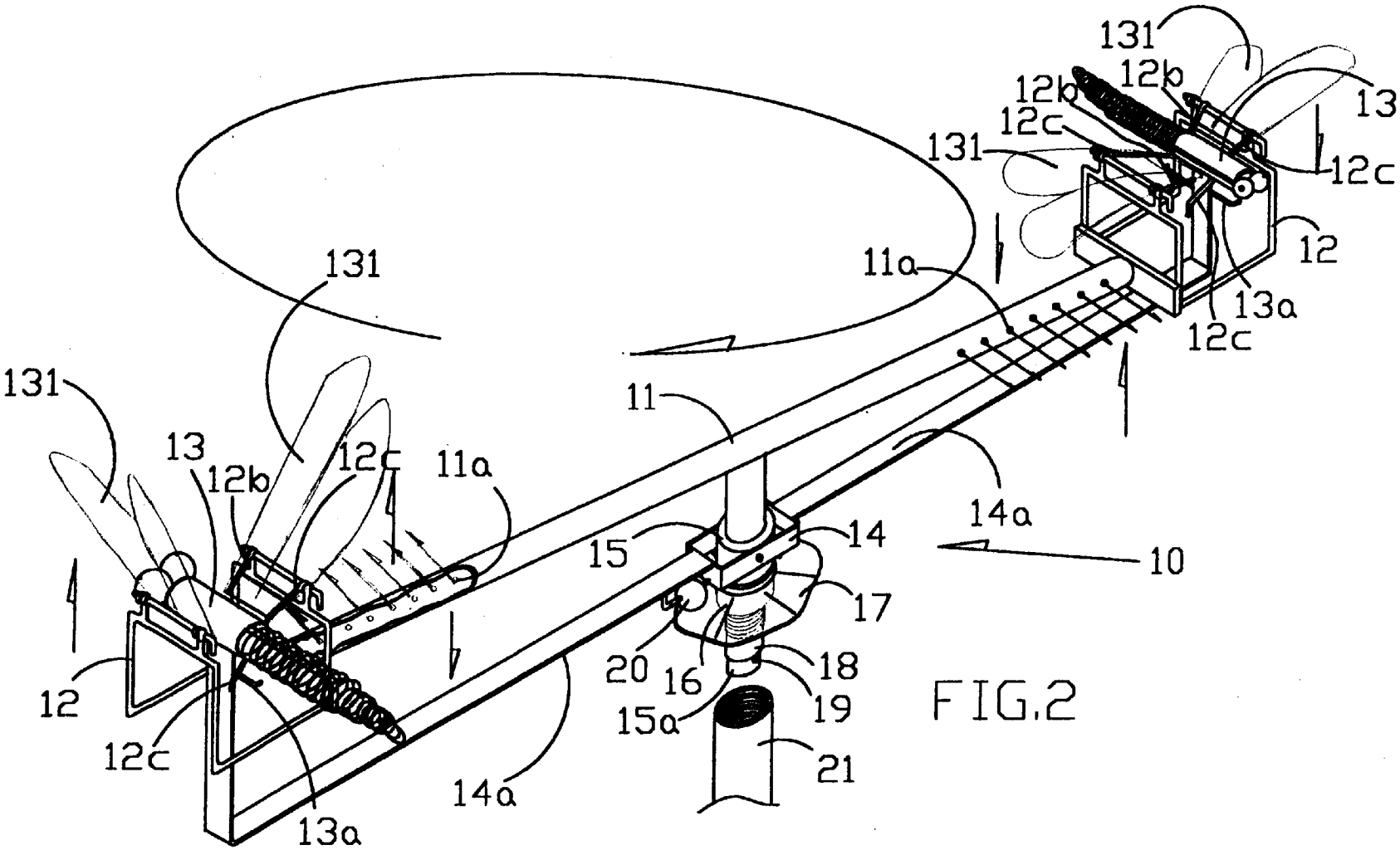
FIG. 2 is a perspective view of the present invention (the mounting rack excluded).
Figure 3:
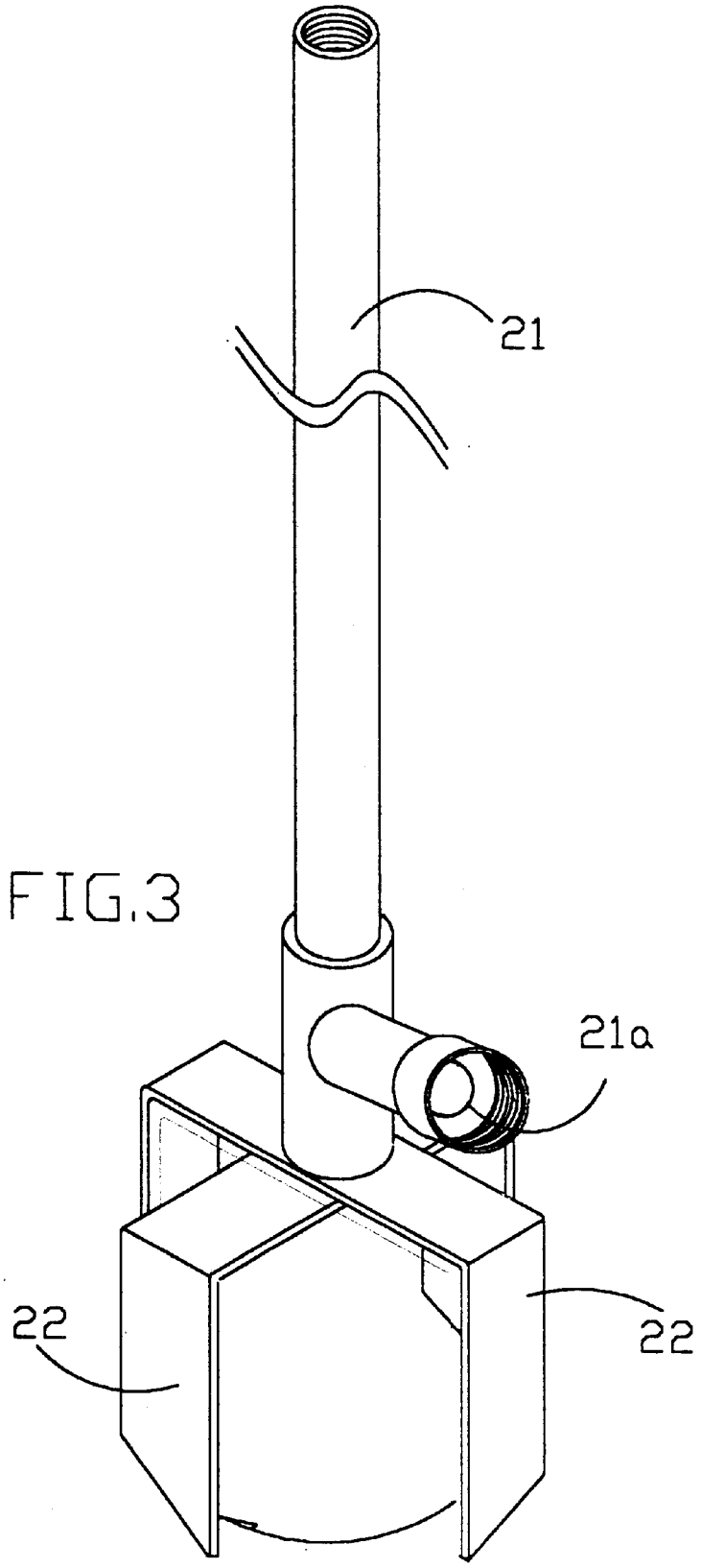
FIG. 3 illustrates the hose connector connected between the rack and the water tube according to the present invention.

Referring to FIG. 2 again, when water is guided from the water source to the swivel sprinkler head 10, it is forced out of the jet nozzles 11*a* of the spray tube 11 and sprinkled on flowers, lawns, and etc. At the same time, the pressure of water passing through the spray tube 11 forces the swivel sprinkler head 10 to rotate on the pipe connector 16 at the water tube 21. When rotating the swivel sprinkler head 10 on the pipe connector 16, the ball 20 is rotated along the curved top surface of the collar 17 of the pipe connector 16, thereby causing the arms 14*a* to be alternatively oscillated up and down. When one of the arms 14*a* is lowered, the stop rods 13*a* of the corresponding ornament 13 are forced downwardly against the actuating bottom end 12*c* of each of the corresponding swivel rods 12*b*, thereby causing the respective wings 131 to be turned upwards. At the same time, the other of the arms 14*a* is lifted, the stop rods 13*a* of the corresponding ornament 13 are released from the actuating bottom end 12*c* of each of the corresponding swivel rods 12*b*, and therefore the respective wings 131 are forced to turn downwards by their gravity weight. Therefore, when water is ejected out of the jet nozzles 11*a* of the spray tube 11, the swivel sprinkler head 10 is rotated on the pipe connector 16, the arms 14*a* are alternatively oscillated up and down, and the wings 131 are alternatively oscillated up and down.

A prototype of swivel lawn sprinkler has been constructed with the features of the annexed drawings. The swivel lawn sprinkler functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A swivel lawn sprinkler comprising:

a mounting rack for mounting;

a water tube, said water tube having a bottom end and a top end;

a hose connector connected between said mounting rack and the bottom end of said water tube to support said water tube on said mounting rack and adapted to receive water from a water source through a hose;

a pipe connector fastened to the top end of said water tube. said pipe connector comprising a collar disposed around the periphery thereof, said collar having a top surface alternatively curved inwards and outwards;

a swivel sprinkler head coupled to said pipe connector and forced to rotate on said pipe connector upon passing of water from said water tube, said swivel sprinkler head comprising a spray tube, said spray tube having a plurality of jet nozzles, two open frames respectively welded to two distal ends of said spray tube, pairs of swivel rods symmetrically coupled to said open frames at two sides, said swivel rods each having an actuating bottom end, a plurality of wings respectively fixedly fastened to said swivel rods, and a connecting tube downwardly extended from said spray tube coupled to said pipe connector and adapted to guide water from said water tube to said spray tube;

a slide sleeved onto said connecting tube and moved along said connecting tube between said pipe connector and said spray tube, said slide comprising two arms respectively outwardly extended from two sides thereof, a ball coupled to one arm and rotatably disposed in contact with the curved top surface said collar, and two ornaments respectively fixedly fastened to said arms and suspending in said open frames, said ornaments each comprising a plurality of stop rods respectively aimed at the actuating bottom end of said swivel rods and adapted to turn said swivel rods and said wings alternatively up and down upon rotary motion of said spray tube with said connecting tube on said pipe connector during sprinkling.

* * * * *